US012559282B2

(12) United States Patent
Seals

(10) Patent No.: US 12,559,282 B2
(45) Date of Patent: Feb. 24, 2026

(54) VESSEL WITH INTERIOR SURFACE BARRIER LAYER

(71) Applicant: Robert Lyn Seals, Los Gatos, CA (US)

(72) Inventor: Robert Lyn Seals, Los Gatos, CA (US)

( * ) Notice: Subject to any disclaimer, the term of this patent is extended or adjusted under 35 U.S.C. 154(b) by 0 days.

(21) Appl. No.: 18/442,042

(22) Filed: Feb. 14, 2024

(65) Prior Publication Data

US 2024/0182200 A1 Jun. 6, 2024

Related U.S. Application Data

(63) Continuation-in-part of application No. 16/740,435, filed on Jan. 11, 2020.

(60) Provisional application No. 63/585,600, filed on Sep. 26, 2023, provisional application No. 63/530,668, filed on Aug. 3, 2023.

(51) Int. Cl.
*B65D 1/02* (2006.01)
*B65D 1/40* (2006.01)

(52) U.S. Cl.
CPC ..... *B65D 1/0215* (2013.01); *B65D 1/40* (2013.01)

(58) Field of Classification Search
CPC ..... B65D 1/0215; B65D 1/40; B65D 25/14; B65D 2581/3478; B65D 2581/3479; B65D 2581/3472
See application file for complete search history.

(56) References Cited

U.S. PATENT DOCUMENTS 4,427,123 A * 1/1984 Komeda ..... A47J 41/028 220/62.12
2005/0107870 A1* 5/2005 Wang ..... B82Y 25/00 623/1.44
2007/0108668 A1* 5/2007 Hutchinson ..... B29C 33/046 425/DIG. 246
2013/0221013 A1* 8/2013 Kolowich ..... A61J 9/00 220/592.17
2014/0205786 A1* 7/2014 Nederberg ..... B65D 1/40 428/411.1
2015/0245421 A1* 8/2015 Heczko ..... H05B 6/1245 99/323.3
2017/0020318 A1* 1/2017 Walker ..... B65D 25/04
2018/0170010 A1* 6/2018 Yoshimura ..... B65D 1/12
2019/0047773 A1* 2/2019 Bullock ..... B65D 41/0414
2020/0156856 A1* 5/2020 Rider ..... B65D 83/382
2020/0223589 A1* 7/2020 Wondka ..... B65D 47/06
2020/0391898 A1* 12/2020 Antipin ..... B65D 1/0207
2021/0024406 A1* 1/2021 Christiansen ..... A47G 19/00
2022/0133068 A1* 5/2022 Sherburne ..... A47J 41/022 426/2

* cited by examiner

*Primary Examiner* — Kareen K Thomas
(74) *Attorney, Agent, or Firm* — Edmond DeFrank

(57) ABSTRACT

Embodiments described herein include a vessel, for example, a beverage container, configured for containing a liquid. The vessel may be formed of a metal body and includes an interior surface barrier layer with a pre-determined surface roughness. In embodiments, the interior surface barrier layer includes a mirror-like, highly reflective finish. In additional or alternative embodiments, the interior surface barrier layer includes an oxide of chromium. In embodiments, the interior surface barrier layer substantially prevents chemical components from the metal body from leaching into the contained liquid. In embodiments, the interior surface barrier layer promotes cleanability and/or sterilization for vessel reuse.

20 Claims, 7 Drawing Sheets

Section A - A

VESSEL WITH INTERIOR SURFACE BARRIER LAYER

CROSS-REFERENCE TO RELATED APPLICATIONS

This Application is a continuation-in-part application of U.S. patent application Ser. No. 16/740,435, filed on Jan. 11, 2020, entitled "METAL BOTTLE INTERIOR PROCESSED TO STOP NICKEL LEACHING AND TASTE ALTERING EFFECTS" and claims the priority benefit of U.S. Provisional Patent Application No. 63/530,668, filed Aug. 4, 2023, and U.S. Provisional Patent Application No. 63/585,600, filed on Sep. 26, 2023, all of which are fully incorporated by reference herein.

BACKGROUND

Reusable water bottles can save consumers the cost of purchasing beverages in a new bottle and are easily refillable from the sink. Landfill disposal of single-use water bottles may be reduced through these reusable bottles. Reusable bottles are often filled and refilled with drinkable liquids, including hot, warm, or cold liquids, such as water, coffee, tea, apple juice, soft drinks, beer, or wine.

The consumer may encounter difficulties or time constraints in cleaning and sanitizing the reusable bottle properly, which may lead to beverage contamination and/or corrosion. The taste of the beverage might be affected by these concerns. The reusable bottle may pose potential health hazards.

SUMMARY

Embodiments described herein include a vessel, for example, a beverage container, configured to contain a liquid. The vessel may be formed of a metal body and includes an interior surface barrier layer with a pre-determined surface roughness. In embodiments, the interior surface barrier layer includes a mirror-like, highly reflective finish.

In an additional or alternative embodiment, the interior surface manufacturing process may include the formation of a passivation layer, such as a thin oxide film layer that acts substantially as a barrier layer for the metal body vessel. The surface configured consumable product contact may be referred to herein as "barrier layer", "barrier", "seal", and "sealed" interchangeably without any change in meaning. The sealed surface configured to contact the liquid product of the metal bottle finish may substantially enable sufficient resistance against metals of the stainless steel from leaching into the liquid, substantially preventing taste-altering effects, substantially preventing chemical reaction and subsequent outgassing from the surface configured to contact the liquid product materials, and substantially enabling clean sterilization of the smooth surface configured to contact the liquid product holding the liquid. Outgassing may occur when a liquid, such as an acidic liquid, comes in contact with a material including a metal in which a gas vapor is created. Preventing this chemical reaction and outgassing may keep such gas(es) from contaminating the contained liquid.

The smooth surface of the present invention is configured to contact the liquid product and increases cleanability because smoother surfaces are easier to clean and sterilize, as opposed to bumpier satin matte or brushed stainless-steel finishes that are commonly applied to reusable stainless-steel bottles. Food contact surface roughness plays a factor in vessel cleanability. Health hazards may be associated with rough surface areas as microorganisms can adhere more easily to irregular surfaces. These rough surfaces, compared to smooth surfaces provide more surface area as well. Additionally, the rough surfaces may further hinder the effectiveness and longevity of cleaning equipment, sanitizers, and cleaning materials. The rough surfaces may provide a hospitable opportunity for microorganisms to multiply, culture, and grow.

The sealed interior surface configured to contact the liquid product of this vessel may be substantially non-porous, non-pitted, non-corroded, highly reflective, and have a mirror-like finish. In this embodiment, the mirror-like sealed surface configured to contact the liquid product enables an easier cleaning and/or sanitization of the interior surface. The smoother sealed interior surface may decrease the opportunity for microorganisms to remain within the bottle and thus, reduce any harmful bacterial buildup in the contained liquid. A porous non-sealed surface configured to contact the liquid product may create more recesses, cavities, and/or holes in the interior surface, thereby providing more attachment locations for microorganisms. The mirror-like surface finish of the sealed interior surface may substantially produce the non-porous, non-pitted, non-corroded surface to substantially eliminate this surface roughness that can provide these attachment locations for microorganisms. Preventing the attachment of microorganisms reduces the opportunity for the microorganisms to grow further, thereby reducing potential infections from bacteria, viruses, and/or other microorganisms harmful to the user.

The chemicals forming the metal vessel body, including at least one potentially toxic metal, may include nickel in an embodiment, and other metallic components in an additional or alternative embodiment. In an embodiment, the thin oxide layer of the sealed interior surface, configured to contact the liquid product, may include chromium oxide. In this embodiment, the chromium oxide may form as a passivation layer to seal the remaining chemical and metal elements within the metal vessel body to keep the liquid beverage from exposure thereto. The barrier layer may substantially prevent the leaching of toxic metals from the vessel body into the beverage contained therein.

In an embodiment, the barrier layer may have a relatively and substantially smooth surface to substantially prevent bacteria, mold, and viruses from culturing due to the substantially non-porous, non-pitted, non-corroded, highly reflective, and mirror-like finish. The relatively and substantially smooth surface of the barrier layer is configured to contact the liquid product to increase cleanability because the smooth surface of the barrier layer is easier to clean and sterilize than bumpier satin matte or brushed stainless-steel finishes that are commonly applied to reusable stainless-steel bottles. This facilitates a substantially sanitized, cleanable, and hygienic interior surface. Additionally, or alternatively, the barrier layer may have a mirror-like finish as well as being relatively smooth. The mirror-like surface finish may produce a substantially non-porous, non-pitted, non-corroded surface to substantially eliminate surface roughness that may provide attachment locations for microorganisms, thereby reducing the opportunity for the microorganisms to grow further, and substantially preventing or reducing potential infections from bacteria, viruses and/or other microorganisms harmful to the user.

The characteristics, features, and functions of the interior surface, including being relatively and substantially smooth, having a reflective, mirror-like surface finish and being substantially corrosion-resistant, may be achieved through a mechanical polishing and buffing process, a chemical process, an electro-polishing process, a chemical-mechanical process, and/or annealing process, as described in more detail herein. In an embodiment, mechanical polishing is used with physical tools and abrasive agents to remove surface imperfections. In an embodiment, chemical polishing is used to produce a surface texture by submerging the interior surface in a chemical solution to dissolve metal surface layers to produce a reflective finish. In an embodiment, electropolishing is used which includes submerging the interior surface in a chemical solution and applying an electric current to the interior surface to dissolve metal ions to control the level of surface metal material removal.

BRIEF DESCRIPTION OF THE DRAWINGS

The drawing figures are for illustrative purposes only. The drawing figures illustrate various embodiments of the invention. The drawing figures are not necessarily drawn to scale.

DETAILED DESCRIPTION

In a following description, reference is made to the accompanying drawings, which form a part hereof, and in which is shown by way of illustration a specific example in which the invention may be practiced. It is to be understood that other embodiments may be utilized and structural changes may be made without departing from the scope of the present invention.

Figure 1:
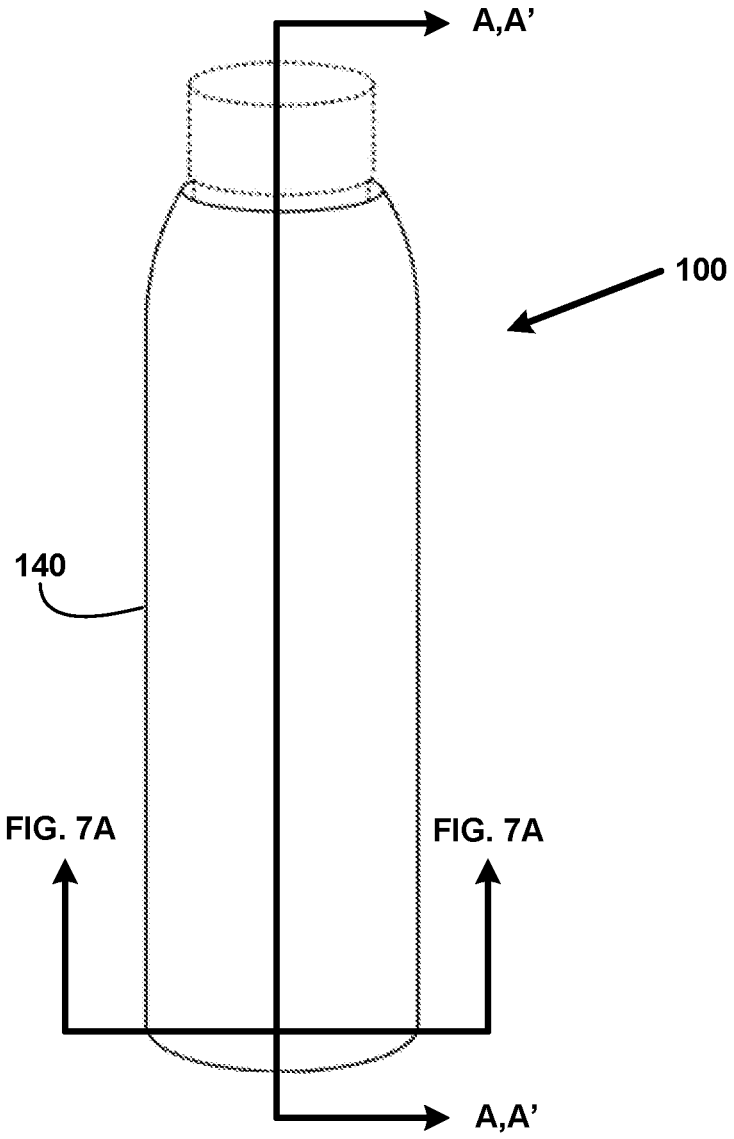
FIG. 1 illustrates an exterior view of an example embodiment of a metal bottle beverage container.

It should be noted that for the example descriptions that follow, a metal vessel 100 of FIG. 1 is described for illustrative purposes and the underlying device may apply to any number and multiple types of metal vessels formed of various compounds and from various processes. In embodiments, the metal bottle beverage container may be configured to include a substantially cylindrical shape, curvilinear, and/or oval-shaped cross-sections.

The terms drinking vessel, metal vessel, vessel, metal bottle beverage vessel, metallic vessel, stainless-steel vessel, beverage container and container used herein are used interchangeably without any change in meaning. The measurements described herein include Imperial and Metric units wherein the measurement units and their equivalents follow measurement standards. The ranges used herein are to illustrate example measurements and dimensions and any dimensional ranges used herein are for illustrative purposes and may vary in other embodiments.

FIG. 1 illustrates an exterior view of an example metal bottle beverage container 100 in an embodiment. In an embodiment, a metal vessel 100 of FIG. 1 may be configured using metal, such as stainless steel or food-grade stainless steel. This drinking vessel 100 of FIG. 1 embodiment may include a metal body comprised of stainless steel including at least one metal, which may be harmful or even toxic if consumed. These components, metals, and chemicals of stainless-steel may include chromium, nickel, molybdenum, carbon, manganese, other chemicals, and other metals including lead, at various percentages based on the type and/or use of the particular stainless-steel grade. Food-grade stainless steel may include 300 series stainless steel or 400 series stainless steel, in particular series 304 or series 316. Vessel 100 of FIG. 1 bodies described herein may alternatively or additionally include an additional metal, a metal alloy, and/or a mix of metal and non-metal materials.

In embodiments, the metal bottle beverage vessel 100 of FIG. 1 may be a stainless-steel type, and/or a metal alloy, i.e., a mix of two or more metals or non-metallic elements. The stainless-steel type of metal may also include recycled stainless steel and/or recycled metal alloys. In embodiments with a mirror-like interior surface finish, the barrier layer of the interior surface configured to contact the liquid product may substantially prevent the leaching of nickel and/or other toxic metals including lead into the liquid product contained by the vessel 100 of FIG. 1.

Figure 2:
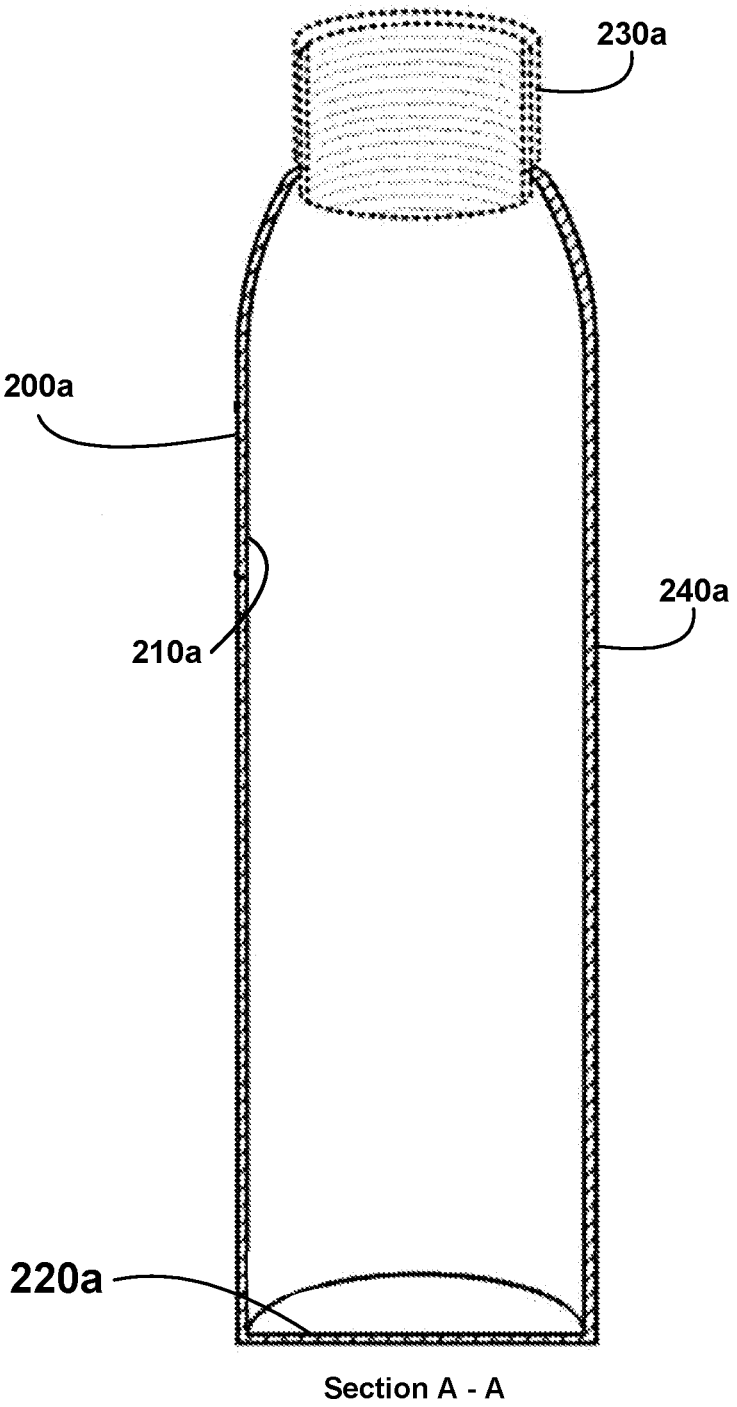
FIGS. 2 and 3 illustrate cross-sectional views of the first and second example embodiments of an interior surface, configured to contact the liquid product, of the metal bottle beverage container of FIG. 1.
Figure 3:
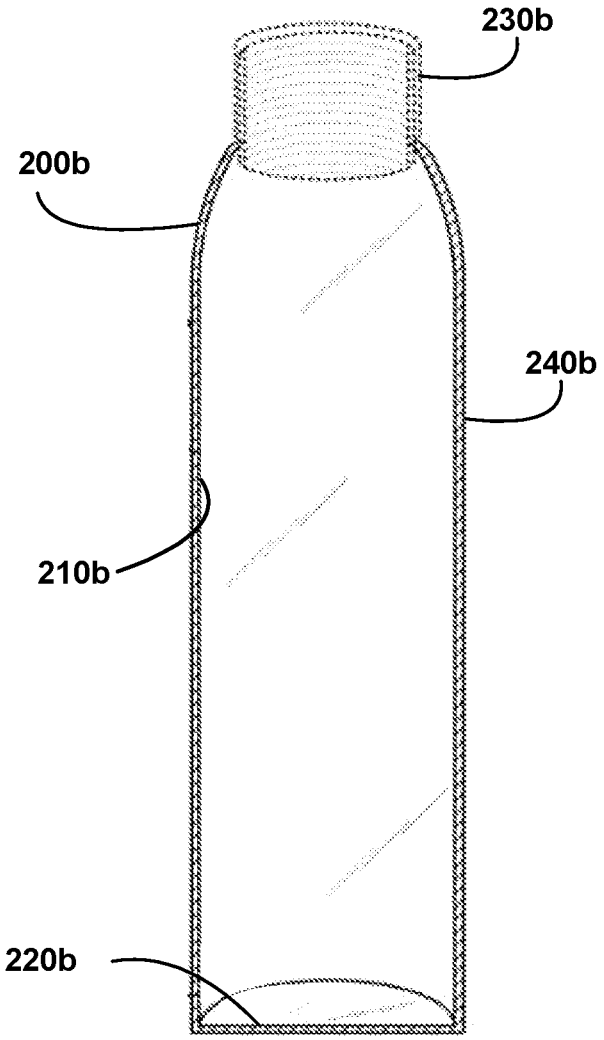

FIG. 2 illustrates a first cross-sectional view of vessel 200*a* in an embodiment where an interior surface of the metal body of the drinking vessel 100 of FIG. 1 may be configured to contain and contact a liquid beverage product with a non-sealed interior surface 210*a*. FIG. 3 illustrates another cross-sectional view of vessel 100 of FIG. 1 with a sealed interior surface 210*b*.

Liquid beverage products may include acidic liquids, pH-neutral liquids, and alkaline liquids. The interior surface configured to contact the liquid product may have an exposed layer formed of chromium oxide covering the interior of the metal vessel body. The oxide of the chromium layer may be formed of an oxide, such as CrO and CrO3. The barrier layer of the sealed interior surface 210*b* of FIG. 3 may include substantially more chromium oxide compared with a percentage level of chromium oxide on a non-sealed surface.

In an embodiment, the chromium oxide may form as a passivation layer to seal the interior surface 210*b* of the metal vessel body 200*b* of FIG. 3. The barrier layer may have a predetermined surface roughness as described in the embodiments herein. Additionally, or alternatively, the barrier layer of the interior surface may be relatively and substantially smooth and have a high-gloss, substantially non-porous mirror-reflective finish. The smooth surface of the barrier layer is configured to contact the liquid product to increase cleanability because the smooth surface of the barrier layer is easier to clean and sterilize than bumpier satin matte or brushed stainless-steel finishes that are commonly applied to reusable stainless-steel bottles.

The barrier layer is configured to resist stainless steel or metal component corrosion, i.e., toxic metal leaching, lead leaching, nickel leaching, taste-altering effects, and/or collection of microorganisms throughout the rough surface. The barrier layer may be configured to seal any potentially harmful contaminants within the stainless-steel vessel 200*b* of FIG. 3 and prevent leaching from the vessel 200*b* into the beverage contained therein, as described in embodiments herein.

In an embodiment, this seal may act to substantially prevent harmful metals or other contaminants from leaching into the liquid beverage. Chemicals including metals and/or reactive outgassing from the stainless steel may be substantially prevented from leaching into the consumable beverage, as shown in various embodiments herein. The chemicals forming the metal vessel body 100 of FIG. 1, including at least one potentially toxic metal, may include nickel in an embodiment, and other metallic or harmful components in an additional or alternative embodiment. The barrier layer embodiments described herein of FIG. 3 may be configured to seal nickel and/or other metals in a stainless steel body to potentially prevent toxicological health risks in an embodiment. The barrier layer may substantially prevent metals and non-metals from leaching in detectable amounts from the metal body into the beverage product.

In an embodiment, the sealed barrier layer of the interior surface 210*b* of FIG. 3 may be configured to form a substantially smooth and/or non-porous surface (with fewer "peaks" and/or "valleys") to enable corrosion-resistance and/or to provide for substantial cleanability and/or ability to sanitize to substantially reduce the possibility of bacteria, mold, and virus culturing on the interior surface 210*b*. The smooth surface of the barrier layer is configured to contact the liquid product to increase cleanability because the smooth surface of the barrier layer is easier to clean and sterilize than bumpier satin matte or brushed stainless-steel finishes that are commonly applied to reusable stainless-steel bottles.

In an embodiment, the sealed barrier layer of the interior surface 210*b* of FIG. 3 may substantially prevent bacteria, mold, and viruses from culturing thereon to facilitate a substantially sanitized, cleanable, and hygienic interior surface 210*b*. In embodiments shown herein, in reusable beverage containers, interior surfaces may meet and/or exceed public health and safety standards applicable to other industries that contain liquids, gases, or solids that may be ingested, inhaled, absorbed, injected, or otherwise consumed by a consumer, to substantially prevent harmful conditions from unintentional contamination.

A manufacturing process may be performed on the interior surface, which is configured to contact the liquid product, to achieve a smooth, corrosion-resistant finish, in an embodiment. In embodiments, the manufacturing process may render the interior surface 210*b* of FIG. 3 a highly reflective or mirror-like finish passivation layer. In embodiments, the vessel 200*b* of FIG. 3 may be configured to include these finishing processes to achieve a sealed interior surface or barrier layer including mechanical, electrical, chemical, and/or any combinations thereof.

In an embodiment, the mechanical polishing manufacturing method may include applying friction to bring chromium to the top surface to create a thin barrier layer of chromium oxide. In another embodiment, a mechanical polishing manufacturing method may be performed on the surface to achieve a smooth, corrosion-resistant finish. In embodiments, the interior surface manufacturing process may include the formation of a passivation layer, such as a thin oxide film layer that acts substantially as a sealant. This sealant may act as a barrier layer, in some embodiments, to seal nickel and/or other metals in the metal vessel body, which may be formed of stainless-steel and/or other metals such as lead, as a substantial prevention of any toxicological health risks to the contained liquid. The characteristics, features, and functions of the sealed interior surface, including being substantially smooth, mirror-like, and substantially corrosion-resistant, may be achieved through a mechanical polishing and buffing process, a chemical process, an electro-polishing process, a chemical-mechanical process, and/or any combinations thereof, as described in more detail herein.

In a particular embodiment, the sealed interior surface may conform to the most reflective finish, an ASTM standard #8 mirror-like finish, or a substantially similar mirror-like finish. In this embodiment, the process includes buffing and polishing process with successively finer abrasive compounds, and then buffing extensively with a very fine chromium green rouge bar compound. The abrasive compounds may include at least about 240 grit to about 400 grit or even up to about 4000 grit.

In an embodiment, an acidic liquid beverage may alter and influence the taste of the liquid beverage. In an embodiment, the sealed interior surface 210*b* of FIG. 3 may be configured to minimize the chemical reactions between acidic, and/or other liquids. Alternatively, or additionally, the sealed interior surface 210*b* of FIG. 3 may be configured to minimize the potential leaching of toxic chemicals into the contained beverage and to have a substantially corrosion-resistant surface. In embodiments described herein, the sealed interior surface may be configured to have substantially less chemical element leaching as compared to a non-sealed surface, for example, a satin-finished and/or a porous surface.

In another embodiment, the sealed interior surface 210*b* of FIG. 3 may be formed to a bright annealed finish or a substantially similar finish. In an embodiment, an annealing manufacturing process may include applying heat to the surface to render a bright finish to include a smooth and sealed interior surface 210*b*. The smooth surface of the barrier layer is configured to contact the liquid product to increase cleanability because the smooth surface of the barrier layer is easier to clean and sterilize than bumpier satin matte or brushed stainless-steel finishes that are commonly applied to reusable stainless-steel bottles.

Referring to FIG. 1, in an embodiment, the metal bottle beverage container 100 may be configured to include a substantially cylindrical shape and/or oval shape cross-section. The embodiment shows the bottle cap 110 made of a substantially rigid material, non-metallic for example, which includes threads to screw one a top surface 120 of the metal bottle beverage container 100. The container has a bottom with a bottom surface 130, the bottom being opposite the top and an exterior surface 140 of FIG. 1 extending from the top to the bottom of the vessel 100 of FIG. 1. The interior surface (not shown) of the container 100 of FIG. 1 may contact and contain the liquid beverage product in an embodiment. The vessel 100 of FIG. 1 is made of a food-grade stainless steel that is unprocessed and has a non-sealed interior surface (not shown) forming a metal vessel body.

Referring to FIG. 2, the vessel 200*a* shown includes a non-sealed interior surface 210*a*, and a non-sealed interior bottom surface 220*a*. The non-sealed interior surfaces 210*a*, and 220*a* may be configured to contact a liquid product contained therein, in an embodiment.

FIG. 2 shows a top orifice 230*a* and exterior surface 240*a*. The top orifice 230*a* includes threads for connecting a cap. The non-sealed interior surfaces 210*a*, and 220*a* may have an exposed stainless-steel finish, such as a brushed, polished, non-reflective, and/or satin finish. The non-sealed interior surfaces 210*a*, and 220*a* may have a rough surface of about 20 micro inches of surface roughness, Ra, as described in embodiments herein. The non-sealed interior surfaces 210*a*, and 220*a* may include pores, peaks, and valleys to provide ample surface area to collect microorganisms and other contaminants. Additionally, or alternatively, leaching may occur through the non-sealed interior surfaces 210*a*, and 220*a*. The smooth surface of the barrier layer is configured to contact the liquid product to increase cleanability because the smooth surface of the barrier layer is easier to clean and sterilize than bumpier satin matte or brushed stainless-steel finishes that are commonly applied to reusable stainless-steel bottles.

FIG. 3 illustrates another cross-sectional view of vessel 100 of FIG. 1. In this cross-sectional view, a sealed interior surface 210*b* of FIG. 3 and a sealed bottom surface 220*b* of FIG. 3 vessel 200*b* is illustrated. FIG. 3 illustrates an example embodiment of a smooth, highly reflective, and/or mirror-like finished interior surface of a metal bottle beverage container 200*b*. The mirror-like interior surface finish forms the barrier layer to create a nonporous surface for contact with a liquid. The interior surface 210*b* and bottom surface 220*b* may come into contact with the liquid product contained in container 200*b*.

An embodiment of the vessel of FIG. 3 may have spiral threads on the exterior surface 240*b* to couple the vessel with a lid 230*b*. In an alternative embodiment, the lid 230*b* may be used with the vessel without threads, such as a press-fit lid 230*b*.

In an embodiment, a thin film oxide may form as a passivation layer over the interior surfaces 210*b*, and 220*b* to seal these interior surfaces of the metal vessel body.

In an embodiment, the interior surfaces 210*b*, and 220*b* may include at least about 90% of oxide of chromium. The mirror-like finish of the interior surfaces 210*b*, and 220*b* may have a reflectivity of at least about 70% for all wavelengths greater than 1020 nm, and/or a reflectivity of at least about 60% for wavelengths of about 425 nm, in embodiments described herein.

In an example embodiment, metal leaching from vessel 200*a* of FIG. 2 and vessel of FIG. 3 are illustrated in the embodiment of Table 1. The vessel 200*b* of FIG. 3 has one or more of the surfaces configured to contact the liquid product characteristics as described herein, according to an embodiment. Vessel 200*a* of FIG. 2 may lack one or more of the barrier layers, as described herein. In this example, each vessel may be filled with the juice of an acidic fruit.

TABLE 1

| Amount of chemical element detected in liquid (as leached from the vessel) | Non-Sealed Interior Surface of Vessel in FIG. 2 | Sealed Interior Surface of Vessel in FIG. 3 | Glass Vessel |
|---|---|---|---|
| chromium, total | not detected | not detected | not detected |
| nickel, total | 0.01 mg/L | Not detected | not detected |

The above table indicates that Nickel may leach into the fruit juice of FIG. 2 embodiment. The above table further indicates that nickel content may not be detectable in the fruit juice within the embodiment of FIG. 3.

A sample roughness or profile of the sealed interior surface 210*b* of FIG. 3 and non-sealed interior surface 210*b* of FIG. 3 are shown in the embodiment of Table 2 below. An interior surface of the vessel 200*a* of FIG. 2 may be measured at three (3) distinct cross-sections of each vessel as shown in Table 2. The surface configured to contact the liquid product profile, from peak to valley, may also be considered an average surface roughness (Ra). The unit of measure of the interior surface profile may be in English or metric units, such as microinches, or millimeters.

TABLE 2

| Sample Locations on the interior surface | Non-Sealed Interior Surface of the Vessel in FIG. 2 | Sealed Interior Surface of Vessel in FIG. 3 |
|---|---|---|
| 1 | 18.62 | 2.550 |
| 2 | 20.4 | 1.98 |
| 3 | 22.16 | 2.420 |

The average surface profile roughness of the vessel 200*a* of FIG. 2 is up to almost 10 times greater than the average surface profile roughness of the vessel 200*b* of FIG. 3, as shown in this Table 2 embodiment. The smooth surface of the barrier layer is configured to contact the liquid product to increase cleanability because the smooth surface of the barrier layer is easier to clean and sterilize than bumpier satin matte or brushed stainless-steel finishes that are commonly applied to reusable stainless-steel bottles.

Figure 4:
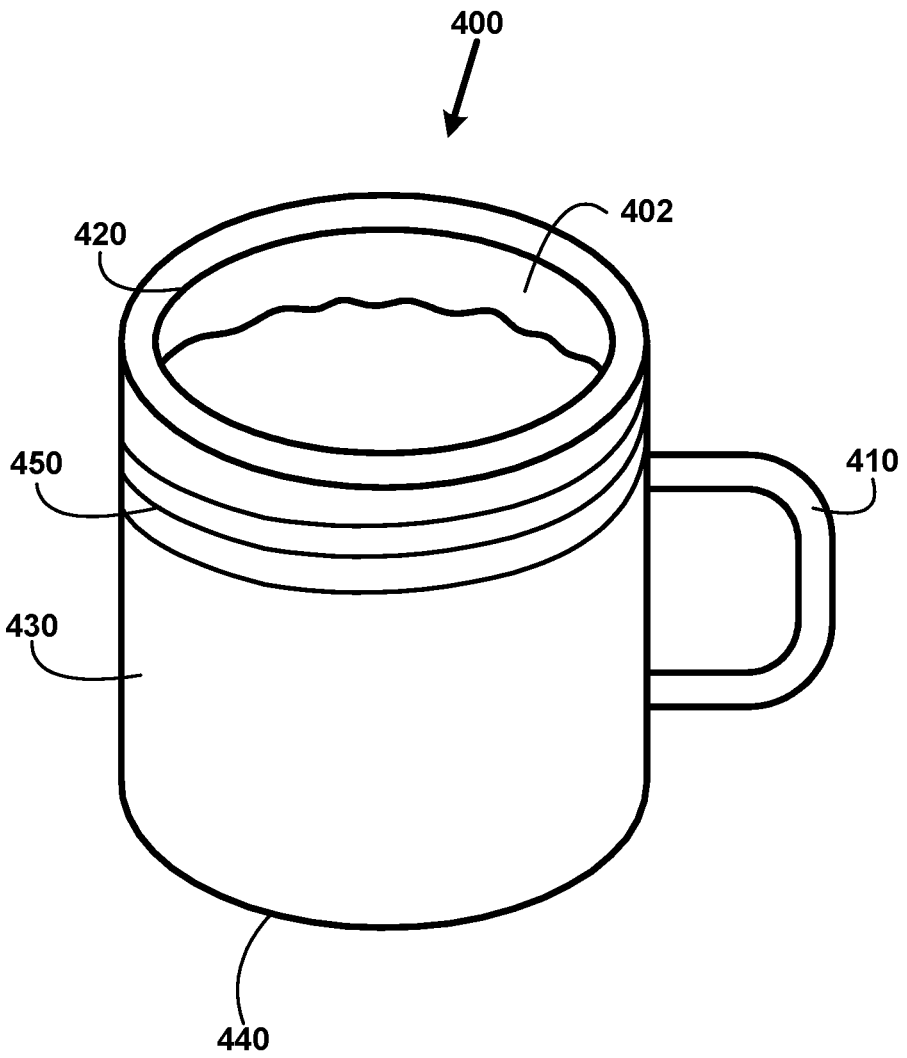
FIG. 4 illustrates an example of a perspective view of a vessel in another example embodiment.

FIG. 4 illustrates an example of a perspective view of another embodiment of a metal body vessel 400 with a sealed interior surface 402. FIG. 4 shows a cup vessel 400 capable of containing a liquid within the sealed interior surface 402 configured to contact the liquid product 402. The cup vessel 400 may include a handle 410 and, a top orifice 420 through which the liquid may flow into a cavity defined by the interior surface configured to contact the liquid product 402. The cup vessel 400 may have an exterior 430 that extends from the top orifice 420 to the bottom 440 of the vessel 400. In an embodiment, the cup vessel 400 may include threads 450 that are configured to secure a bottle cap over the top orifice 420.

Figure 5:
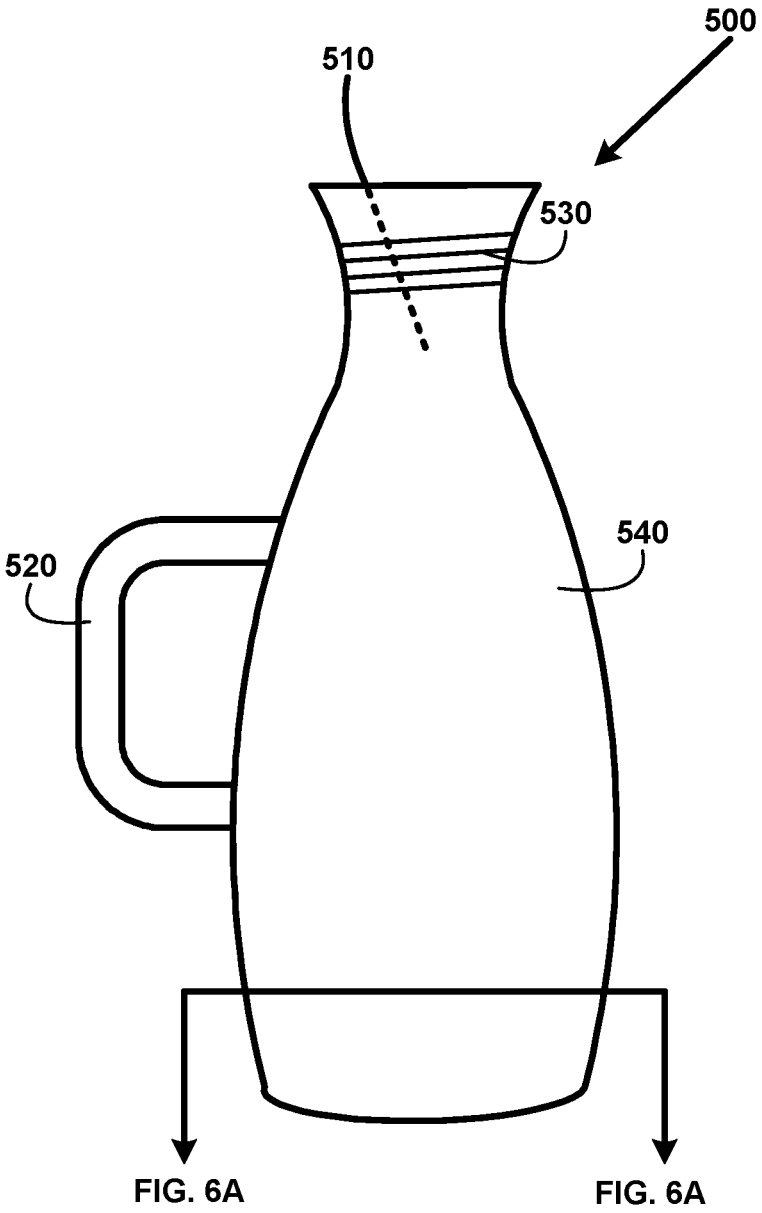
FIG. 5 illustrates an example of a perspective view of a vessel in an example embodiment.

FIG. 5 illustrates an example of a perspective view of a pitcher vessel in an embodiment. FIG. 5 shows a pitcher vessel 500 with an interior surface (hidden) 510, a handle 520, and threads 530 for attaching a bottle cap. The pitcher vessel 500 may be a metal leaching vessel with a non-sealed interior surface. An exterior surface 540, or its composition, may not affect the leaching of metal components from the metal body.

Figure 6A:
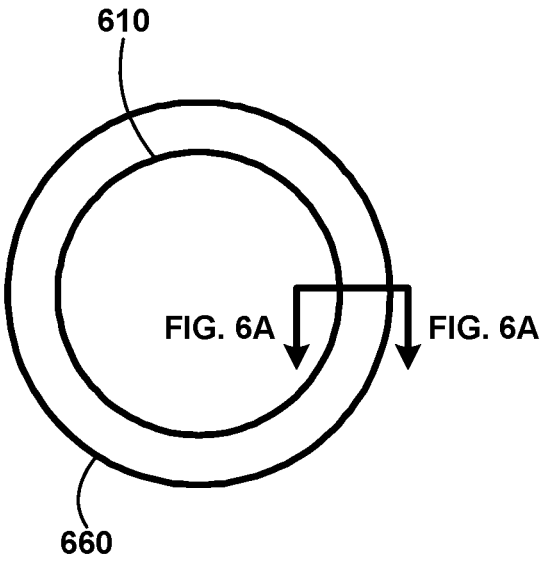
FIGS. 6A and 6B illustrate example cross-sectional views of a non-sealed interior surface of the vessel of FIG. 5, according to an embodiment.

FIG. 6A illustrates an example cross-sectional view of the metal bottle vessel 500 of FIG. 5, according to an embodiment. FIG. 6A shows the non-sealed interior surface 610 and exterior surface 660 of the vessel 500. The non-sealed interior surface 610 is configured to contact and contain a liquid product (not shown) in the embodiment illustrated in FIG. 6A.

Figure 6B:
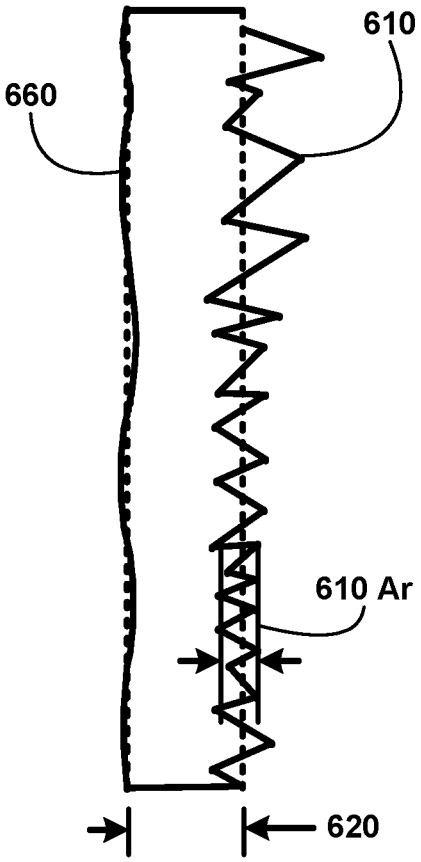

FIG. 6B illustrates an example cross-sectional view of the metal bottle vessel 500 of FIG. 5, according to an embodiment. In this embodiment, peaks and valleys are illustrated along the non-sealed interior surface 610 having a thickness 620. The average surface roughness, Ra, of non-sealed interior surface 610 may be calculated using about 5 peaks and about 5 valleys, for example, as illustrated in this embodiment, and as shown in the example embodiment of Table 2, herein. Surface roughness average may alternatively be determined using peak and valley differences for a select distance in an embodiment.

Figure 7A:
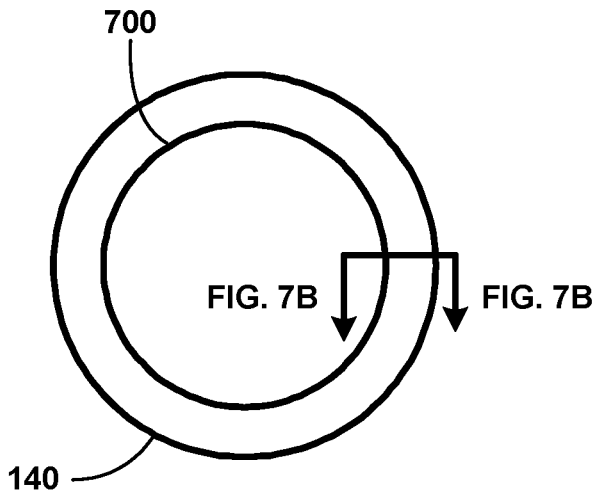
FIGS. 7A and 7B illustrate example cross-sectional views of a sealed interior surface, configured to contact the liquid product of the vessel of FIG. 1, according to an embodiment.

FIG. 7A illustrates an example cross-sectional view of the metal bottle vessel 100 of FIG. 1, according to an embodiment. FIG. 7A shows sealed interior surface 700 and exterior surface 140 of the vessel. The sealed interior surface 700 is configured to contact and contain a liquid product (not shown) in the embodiment illustrated in FIG. 7A.

Figure 7B:
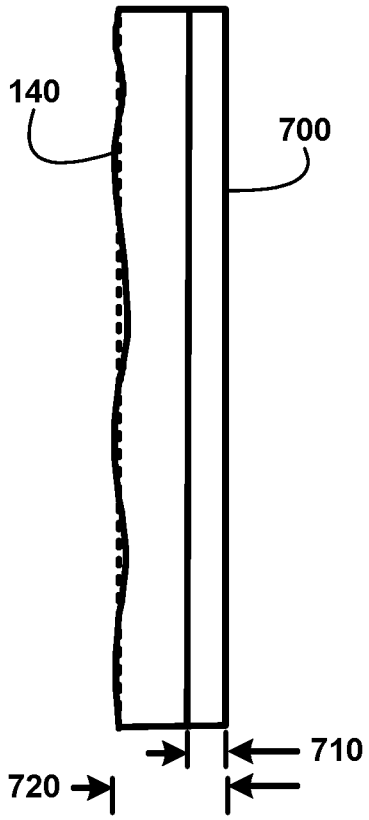

FIG. 7B illustrates an example cross-sectional view of the metal bottle vessel 100 of FIG. 7A, according to an embodiment. FIG. 7B shows the sealed interior surface 700 and the exterior surface 140. In embodiments, the sealed interior surface 700 includes a barrier layer 710 having a thickness 720. The thickness 720 of the barrier layer 710 may be in a range of about 1 nm to about 5 nm, in an embodiment. In an embodiment, the barrier layer 710 may additionally include a mirrored finish, as described herein. The smooth surface of the barrier layer is configured to contact the liquid product to increase cleanability because the smooth surface of the barrier layer is easier to clean and sterilize than bumpier satin matte or brushed stainless-steel finishes that are commonly applied to reusable stainless-steel bottles.

In this embodiment, the sealed interior surface 700 may have an average surface roughness, Ra, as shown in the embodiment of Table 2. The average roughness, Ra, may be calculated using an arithmetic average of multiple surface point height measurements in an embodiment. Measurements, in embodiments, may indicate a surface roughness of no more than 3 microinches in an embodiment. In an embodiment, the polished interior surface may have a surface roughness range from about 1 microinches to up to about 10 microinches. In other embodiments, the Roughness Average of the sealed interior surface may be about 2 micro inches, with surface roughness at discrete areas being from about 1 microinch to about 2.5 microinches.

In alternative embodiments, the surface roughness value in micrometers may include values at and/or about 0.47 micrometers, values in the range of about 0.05 micrometers to about 0.065 micrometers in embodiments, values less than or equal to about 0.1 micrometers in embodiments, and values less than or equal to about 0.2 micrometers in embodiments.

A root-mean-squared roughness, Rq or rms, may yield a square root of a summation of the squares of multiple surface point heights of the interior surface. In an embodiment, Rq for the sealed interior surface is about 1.4 times the Ra in micrometers. In an embodiment, where the surface profile Ra is at most 2.5 microinches, Rq may be at most about 3.5.

The foregoing has described the principles, embodiments, and modes of operation of the embodiments. However, the embodiments should not be construed as being limited to the particular embodiments discussed. The above-described embodiments should be regarded as illustrative rather than restrictive, and it should be appreciated that variations may be made in those embodiments by workers skilled in the art without departing from the scope of the present invention as defined by the following claims.

What is claimed is:

1. A metal vessel for consumable beverages, comprising:

a metal body configured for containing a liquid beverage, the metal body including-food-grade stainless steel including at least one first metal;

an interior surface of the metal body configured to receive the liquid beverage, the interior surface having been treated with at least one of a mechanical, chemical, or electro-polishing process to create a nonporous mirror-like finish on the interior surface so it has a reflectivity of at least 60% at 425 nm and at least about 70% for wavelengths greater than 1020 nm, wherein the interior surface having been further treated with at least one of a buffering or an annealing process to create a predetermined arithmetic average surface roughness of less than about 3 microinches on the interior surface to enable the interior surface to be cleanable and hygienic to a predetermined level of microorganism-free.

2. The metal vessel for consumable beverages of claim 1, wherein the metal body is made with food-grade stainless steel selected from the group consisting of 304 stainless steel and 316 stainless steel, the stainless steel being configured to maintain durability, corrosion resistance, and compliance with food-contact safety standards.

3. The metal vessel for consumable beverages of claim 1, wherein the interior surface during manufacturing is passed through a sanitization cycle using steam and ultraviolet exposure and verifying by microbial assay that the surface is hygienic to a predetermined level that is microorganism-free.

4. The metal vessel for consumable beverages vessel of claim 1, wherein the mirror-like finish includes an ASTM #8 surface finish.

5. The metal vessel for consumable beverages of claim 1, wherein the mirror-like finish includes a reflectivity of at least about 70% for all wavelengths greater than 1020 nm.

6. The metal vessel for consumable beverages of claim 1, wherein the mirror-like finish includes a reflectivity of at least about 60% for wavelengths of about 425 nm.

7. The metal vessel for consumable beverages of claim 1, wherein the mirror-like finish of the interior surface includes a surface smoothed by a mechanical and chemical finishing process.

8. The metal vessel for consumable beverages of claim 1, wherein the predetermined surface roughness has a surface profile measured by an arithmetic average roughness of less than about 3 microinches.

9. The metal vessel for consumable beverages of claim 1, wherein the interior surface layer is non-porous.

10. A metal vessel for consumable beverages, comprising:

a metal body configured to contain a consumable beverage, the metal body including-food-grade stainless steel including at least one first metal;

a interior surface of the metal body configured to receive the consumable beverages, the interior surface having been treated with at least one of a mechanical, chemical, or electro-polishing process to create body, a nonporous mirror-like finish on the interior surface so it has a reflectivity of at least 60% at 425 nm and at least about 70% for wavelengths greater than 1020 nm, wherein the interior surface having been further treated with at least one of a buffering or an annealing process to create a predetermined arithmetic average surface roughness of less than about 3 microinches on the interior surface to enable the interior surface to be cleanable and hygienic to a predetermined level of microorganism-free; and wherein the metal body is made with food-grade stainless steel selected from the group consisting of 304 stainless steel and 316 stainless steel, the stainless steel being configured to maintain durability, corrosion resistance, and compliance with food-contact safety standards.

11. The metal vessel for consumable beverages of claim 10, wherein the sealed interior surface includes a bright annealed finish.

12. The metal vessel for consumable beverages of claim 10, wherein the sealed interior surface includes an ASTM #8 surface finish.

13. The metal vessel for consumable beverages of claim 12, wherein the ASTM #8 surface finish includes a reflectivity of at least about 70% for all wavelengths greater than 1020 nm.

14. The metal vessel for consumable beverages of claim 12, wherein the ASTM #8 surface finish includes a reflectivity of at least about 60% for wavelengths of about 425 nm.

15. The metal vessel for consumable beverages of claim 12, wherein the ASTM #8 surface finish includes a surface finish smoothed by a mechanical and chemical finishing process.

16. A drinking vessel for consumable beverages, comprising:

a metal body configured to contain a consumable beverage, the metal body including-food-grade stainless steel including at least one first metal;

a metal body configured to contain a consumable beverage, wherein the metal body includes-food-grade stainless steel including at least one first metal;

wherein the metal body interior surface comprises a mirror-like finish having a reflectivity at least equivalent to an ASTM standard #8 finish, wherein the interior surface comprises a predetermined arithmetic average surface roughness of about 2.5 microinches;

wherein the ASTM #8 surface finish includes a reflectivity of at least about 60% for wavelengths of about 425 nm;

wherein the interior surface of the metal body is configured to receive the consumable beverages, the interior surface having been treated with at least one of a mechanical, chemical, or electro-polishing process to create a nonporous mirror-like finish on the interior surface so it has a reflectivity of at least 60% at 425 nm and at least about 70% for wavelengths greater than 1020 nm; and wherein the metal body is made with food-grade stainless steel selected from the group consisting of 304 stainless steel and 316 stainless steel, the stainless steel being configured to maintain durability, corrosion resistance, and compliance with food-contact safety standards.

17. The drinking vessel for consumable beverages of claim 16, wherein the metal body comprises a first metal, and is configured to seal the first metal within the metal body to prevent reduce bacterial growth and be easy to clean thoroughly.

18. The drinking vessel for consumable beverages of claim 16, wherein the ASTM #8 surface finish includes a surface finish smoothed by a mechanical and chemical finishing process.

19. The drinking vessel for consumable beverages of claim 16, wherein one or more interior surfaces are configured to include a bright annealed finish.

20. The drinking vessel for consumable beverages of claim 16, wherein one or more interior surfaces are configured to be non-porous and substantially corrosion-resistant.

* * * * *